US009759537B1

(12) United States Patent
Smith et al.

(10) Patent No.: US 9,759,537 B1
(45) Date of Patent: Sep. 12, 2017

(54) ARMING GENERATOR RELOCATOR ADAPTOR

(71) Applicants: Dynetics, Inc., Huntsville, AL (US); The United States of America as represented by the Secretary of the Air Force, Washington, DC (US)

(72) Inventors: Jerry C. Smith, Huntsville, AL (US); Bruce C. Patterson, Niceville, FL (US)

(73) Assignees: Dynetics, Inc., Huntsville, AL (US); The United States of America as Represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 15/054,932

(22) Filed: Feb. 26, 2016

Related U.S. Application Data

(60) Provisional application No. 62/126,203, filed on Feb. 27, 2015.

(51) Int. Cl.
*F42C 15/24* (2006.01)
*F42C 15/40* (2006.01)
*F42B 12/20* (2006.01)

(52) U.S. Cl.
CPC ..... *F42C 15/40* (2013.01); *F42B 12/204* (2013.01); *F42B 12/207* (2013.01)

(58) Field of Classification Search
CPC ..... F42C 15/24; F42C 15/188; F42C 9/048; F42C 9/041; F42C 9/045
USPC ..... 102/249
See application file for complete search history.

(56) References Cited

U.S. PATENT DOCUMENTS 3,165,059 A * 1/1965 Saunders ..... F42C 11/006 102/255
3,657,958 A * 4/1972 Wells ..... F42C 15/188 102/256
3,707,912 A * 1/1973 Duncan ..... F42C 1/14 102/265
3,961,577 A * 6/1976 O'Steen ..... F42C 15/295 102/208
3,964,396 A * 6/1976 Herold ..... F42B 4/12 102/238
H453 H * 4/1988 Schmidlin ..... F42C 15/188 102/221
5,005,482 A * 4/1991 Reams ..... F42C 14/045 102/223

* cited by examiner

*Primary Examiner* — Samir Abdosh
(74) *Attorney, Agent, or Firm* — Stephen H. Hall; Bradley Arant Boult Cummings LLP

(57) ABSTRACT

The present disclosure generally relates to an improved penetrator design and associated arming generator relocator adaptor. In some embodiments, the arming generator relocator adaptor is positioned external to the penetrator, thereby removing the need to mount the FZU inside the warhead or include traditional internal plumbing. The arming generator relocator adaptor allows the FZU to be rotated to an optimal position to arm the penetrator. While the improved penetrator design and arming generator relocator adaptor can be used independently of each other, in the preferred embodiment, they are utilized together.

20 Claims, 22 Drawing Sheets

ARMING GENERATOR RELOCATOR ADAPTOR

CROSS-REFERENCE TO RELATED APPLICATIONS

This application claims priority to, and the benefit of, U.S. Application Ser. No. 62/126,203 titled "Arming Generator Relocator Adaptor", filed Feb. 27, 2015, the entire contents of which are herein incorporated by reference.

STATEMENT REGARDING FEDERALLY SPONSORED RESEARCH OR DEVELOPMENT

This invention was made with government support under Contract Number W15QKN-14-9-1001-DOTC-14-01-INIT486 awarded by the United States Air Force. The government has certain rights in the invention.

BACKGROUND OF THE INVENTION

Field and Background of the Invention

The present invention is in the technical field of penetrating weapons (or warheads), and more specifically to an improved penetrator design and arming generator relocator adaptor. Most legacy penetrators have a feature known as a charging well, which is essentially a component which mounts inside a very large hole in the warhead casing to locate and mount a fuze arming generator (FZU). In addition to the charging well, plumbing components are used to channel FZU wires from the charging well, through the interior portion of the warhead casing through the explosive material aft to the fuze well. This arrangement has been identified to cause several issues, including but not limited to: (a) stress concentrations in the warhead casing, causing warhead casing failure/breakage during the penetration event; (b) plumbing components being ripped loose and/or moving inside the warhead during a penetrating event, leading to a premature reaction of the explosive material and failure of the munition; and (c) the charging well can be ejected, exposing explosive material to the severe friction and shock environment of the penetration event, leading to a premature reaction of the explosive material and failure of the munition. Because of these failure modes, improvements to the penetrating warheads are needed.

SUMMARY OF THE INVENTION

The present invention improves upon the existing warhead designs, and reduces or eliminates many of the failure modes of existing warhead designs. In some embodiments, the invention involves a new design of a penetrator (or warhead) that removes the internal plumbing, the charging well, and the charging well hole in the casing. In some embodiments, the invention involves an Arming Generator Relocator Adaptor ("AGRA"). In order for the system to still function with existing FZU and fuze systems, the AGRA was designed to relocate existing FZU's to an alternate location external to the warhead while retaining FZU function and wire routing to the fuze.

In some embodiments, the new penetrator design can be used with alternative FZU designs (other than with the disclosed AGRA). In some embodiments, the disclosed AGRA can be used with other alternative penetrator designs.

In other embodiments, and in the preferred embodiment, the disclosed AGRA and new penetrator design are used together.

In one embodiment of the invention, a fuze arming generator ("FZU") mounting module (also referred to herein as the "AGRA module") is provided comprising, (a) a chassis having a forward end, an aft end, a center arm, and openings configured to receive an adaptor pin; (b) a cam arm connected to the chassis, said cam arm having a forward end, an aft end, first recess position depression, second recess position depression, and dividing ridge between the first recess position depression and second recess position depression; and (c) a FZU adaptor comprising a cavity, openings to receive a safety hinge pin, and at least one FZU adaptor pin on the FZU adaptor exterior, wherein the FZU adaptor is connected to the chassis by a safety hinge pin through its openings, wherein the FZU adaptor is rotatable about the axis of the safety hinge pin, and wherein the FZU adaptor pin is moveable between the cam arm first recess position depression and second recess position depression when the FZU adaptor is moved from a stowed position to an open position. In some embodiments, the FZU adaptor cavity is threaded. In some embodiments, the FZU adaptor further comprises adaptor holes in the bottom to receive arming wires. The chassis may also have securing holes at its forward end and aft end. In some embodiments, the forward end of the chassis and the forward end of the cam arm are connected, and wherein the connection between the aft end of the chassis and aft end of the cam arm comprises springs and spring pins. The FZU adaptor may be rotatable at least about 90 degrees, and configured such that the FZU adaptor is substantially horizontal in a stowed position and substantially vertical in an open position. In some embodiments, the FZU mounting module is secured to a penetrator hardback. In some embodiments, the invention further comprises a FZU seated in the FZU adaptor cavity.

In other embodiments, the FZU mounting module is provided comprising, (a) a chassis; (b) a cam arm connected to the chassis; and (c) a FZU adaptor comprised of a cavity configured to receive a FZU and at least one FZU adaptor pin on its exterior surface, wherein the FZU adaptor is attached to the chassis and is rotatable about an axis defined by the connection between the chassis and FZU adaptor, and wherein the FZU adaptor pin is seated in a channel formed between the connection between the chassis and cam arm. In some embodiments, the internal cross section of the FZU adaptor cavity is circular in shape and threaded. In some embodiments, the cam arm comprises a first recess position depression and a second recess position depression, and wherein the FZU adaptor pin is seated in the first recess position depression in a stowed position and the second recess position depression in an open position. In some embodiments, the connection between the chassis and cam arm comprises springs and spring pins. In some embodiments, the chassis and cam arm are connected at their forward ends. In some embodiments, the FZU adaptor has flat exterior faces. In some embodiments, the FZU adaptor is rotatable at least about 90 degrees, and configured such that the FZU adaptor is substantially horizontal in a stowed position and substantially vertical in an open position. In some embodiments, the FZU mounting module is mounted on the exterior of a penetrator.

In other embodiments, a FZU mounting module is provided comprising (a) a chassis having a forward end, an aft end, and openings configured to receive a safety hinge pin; (b) a FZU adaptor attached to the chassis by a safety hinge pin, and rotatable about an axis of the safety hinge pin, the FZU adaptor having a threaded cavity having an internal circular cross section, and wherein the FZU adaptor is substantially horizontal in a stowed position and substantially vertical in an open position, and wherein the chassis is attachable outside of a penetrator casing. In some embodiments the FZU adaptor further comprises at least one FZU adaptor pin on its exterior, and the FZU adaptor pin is seated in a first position in a channel in a stowed position and a second position in the channel in the open position. In some embodiments, the FZU adaptor is rotatable at least about 90 degrees, and configured such that the FZU adaptor is substantially horizontal in a stowed position and substantially vertical in an open position. In some embodiments, the FZU adaptor has flat exterior faces.

BRIEF DESCRIPTION OF THE DRAWINGS

It should be noted that identical features in different drawings are generally shown with the same reference numeral. Various other objects, features and attendant advantages of the present invention will become fully appreciated as the same becomes better understood when considered in conjunction with the accompanying drawings.

DETAILED DESCRIPTION OF THE INVENTION

FIGS. 1 through 19 illustrate various views and embodiments of the present invention. Various embodiments may have one or more of the components outlined below. Generally, the following reference numbers are used for the following components:

| | |
|---|---|
| AGRA assembly | 1 |
| AGRA Module | 2 |
| Forward Arming Wire Manifold | 3 |
| Arming Wire Conduit | 4 |
| Aft Arming Wire Manifold | 5 |
| FZU Adaptor | 6 |
| Chassis | 7 |
| Cam Arm | 8 |
| Safety Hinge Pin | 9 |
| Cam Hinge Pin | 10 |
| Spring Pin | 11 |
| Spring | 12 |
| Spring Cup | 13 |
| Detent Spring Pin | 14 |
| Washer | 15 |
| Cotter Pin | 16 |
| Spring Pin Retaining Pin | 17 |
| Locking Helical Threaded Insert | 18 |
| Penetrator | 20 |
| Penetrator casing | 21 |
| Suspension lug | 25 |
| Legacy Charge well | 35 |
| Legacy Internal plumbing | 40 |
| FZU arming wires | 50 |
| fuze well | 52 |
| Arming cable | 55 |
| Aft end (of penetrator) | 60 |
| FZU adaptor cavity | 65 |
| FZU adaptor holes | 70 |
| FZU adaptor pin | 75 |
| FZU adaptor cam hinge pin holes | 80 |
| FZU adaptor flat face | 85 |
| FZU adaptor angled base | 90 |
| Stowed recess position depression | 95 |
| Dividing ridge | 100 |
| Open recess position depression | 105 |
| Hardback | 110 |
| Lanyard | 115 |
| FZU | 120 |
| Securing holes | 125 |
| Chassis center arm | 130 |
| Detent spring pin hole | 135 |
| Safety hinge pin arm shelf | 140 |
| Hinge pin arm | 145 |
| Chassis forward end | 150 |
| Cam arm forward end | 155 |
| Openings | 160 |
| Forward extension (cam arm) | 165 |
| Downward extension (chassis) | 170 |
| Chassis aft end | 175 |
| Cam arm aft end | 180 |
| Chassis recess | 185 |
| FZU adaptor engaging face | 190 |
| Leading edge (spring pin) | 195 |
| Top surface (FZU adaptor) | 205 |

Figure 1:
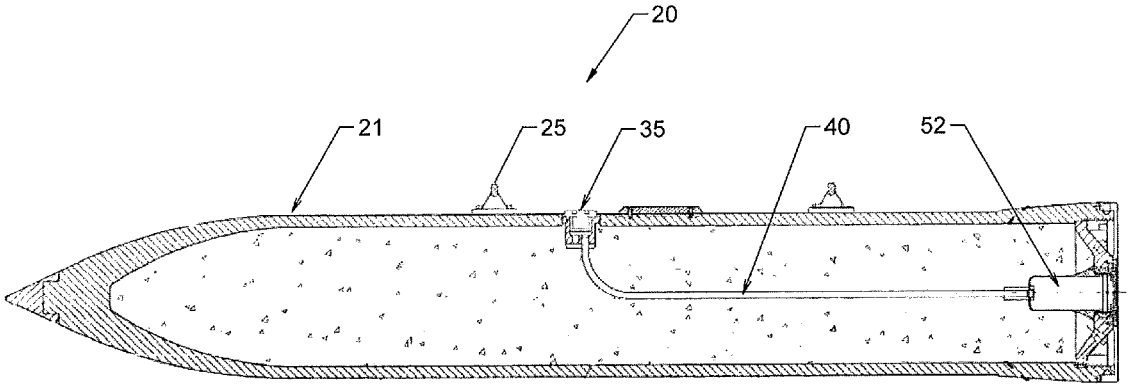
FIG. 1 shows the cross section of a legacy penetrator.

FIG. 1 shows a legacy, traditional penetrator 20 cross section. It should be recognized that the term "penetrator" as used herein generally refers to any type of warhead, bomb, or missile that is armed upon deployment. For simplicity, the term penetrator is generally used throughout this specification, but covers these other configurations as well.

As shown in FIG. 1, legacy penetrators 20 will often have a charging well 35 and internal plumbing 40 for FZU arming wires 50 (not shown), which leads back to the fuze well 52. This charging well 35 requires a large hole in the penetrator casing 21 which becomes a structural issue during a penetration event. Also shown are suspension lugs 25 that are often utilized to assist in handling the penetrator.

Figure 2:
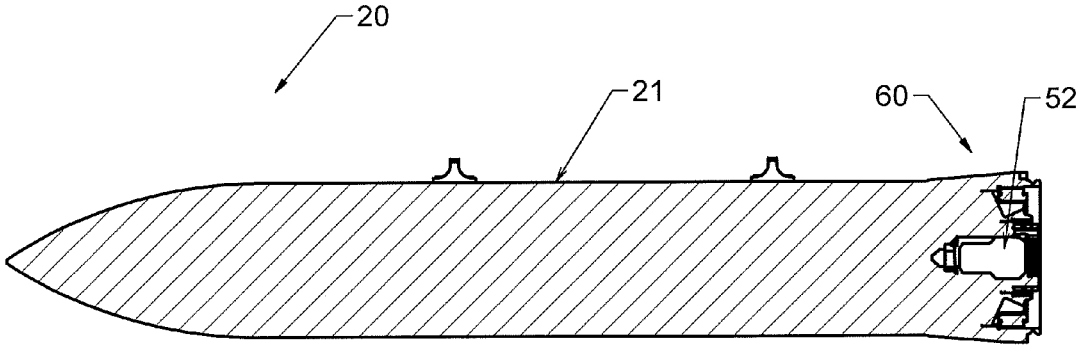
FIG. 2 shows the cross section of one embodiment of an improved penetrator design of the present invention.

FIG. 2 shows one embodiment of an improved penetrator 20 design. As shown in FIG. 2, the improved penetrator does not have a hole in the penetrator casing 21 to accommodate the charging well 35, nor does it require internal plumbing 40. In this embodiment, the fuze well 52 can be accessed by the FZU arming wires (not shown) externally from the aft end 60 of the penetrator 20. Using this improved penetrator configuration drives the need for external plumbing and components that can still arm the penetrator upon deployment. One benefit of this design is that that it removes the need for a connection between the internal plumbing 40 (which runs through the explosive material in the traditional, legacy design) and the fuze well 52. The new design allows the explosive material to be contained and sealed in the penetrator 20, without risk of a failure point between the plumbing 40 and fuze well 52, or the plumbing 40 becoming loose or moving inside the penetrator 40 which can cause a premature reaction of the explosive material and failure of the munition.

Figure 3:
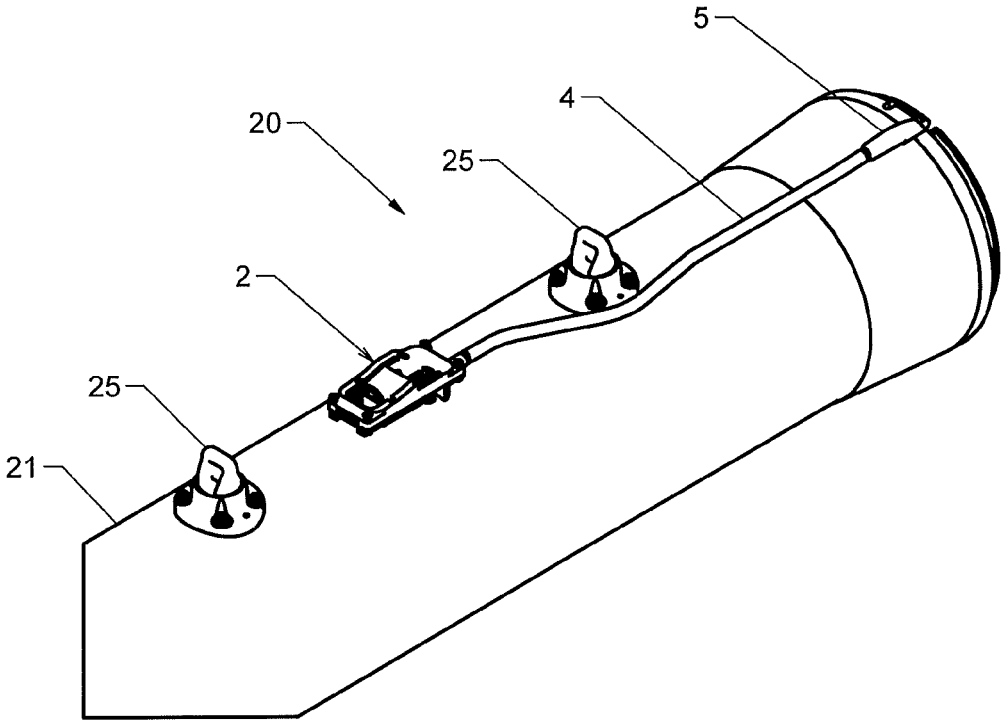
FIG. 3 shows one embodiment of the AGRA assembly positioned external to the improved penetrator design.
Figure 4:
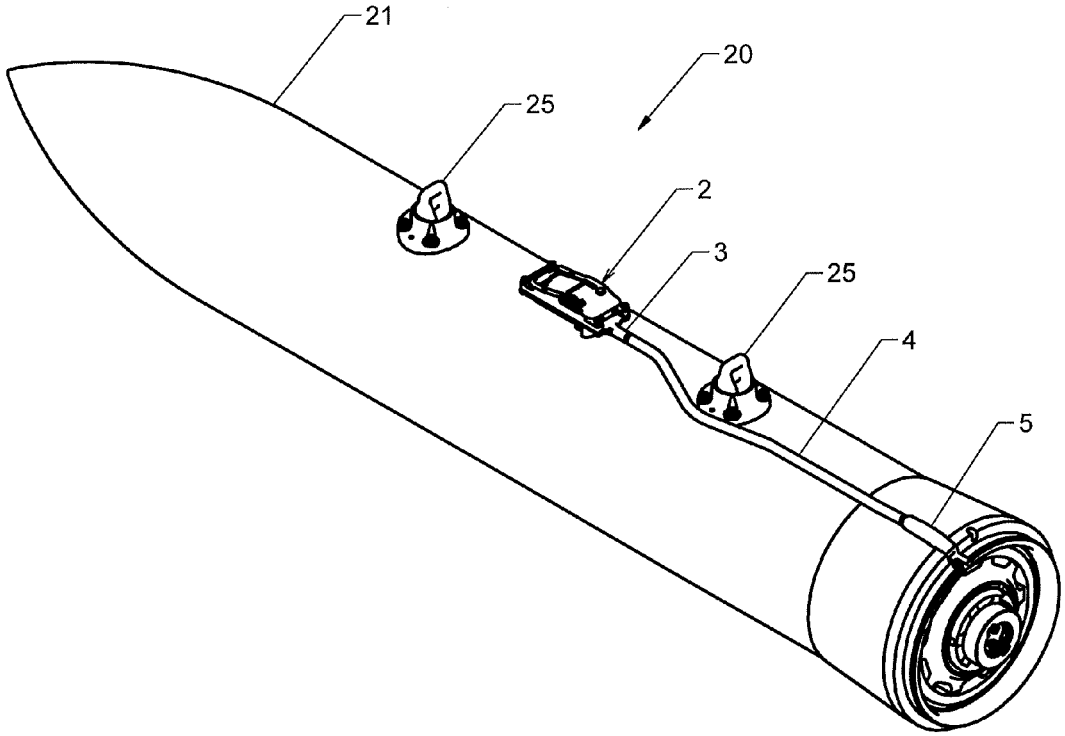
FIG. 4 shows another view of the embodiment of the AGRA assembly shown in FIG. 3 positioned external to the improved penetrator design.
Figure 5:
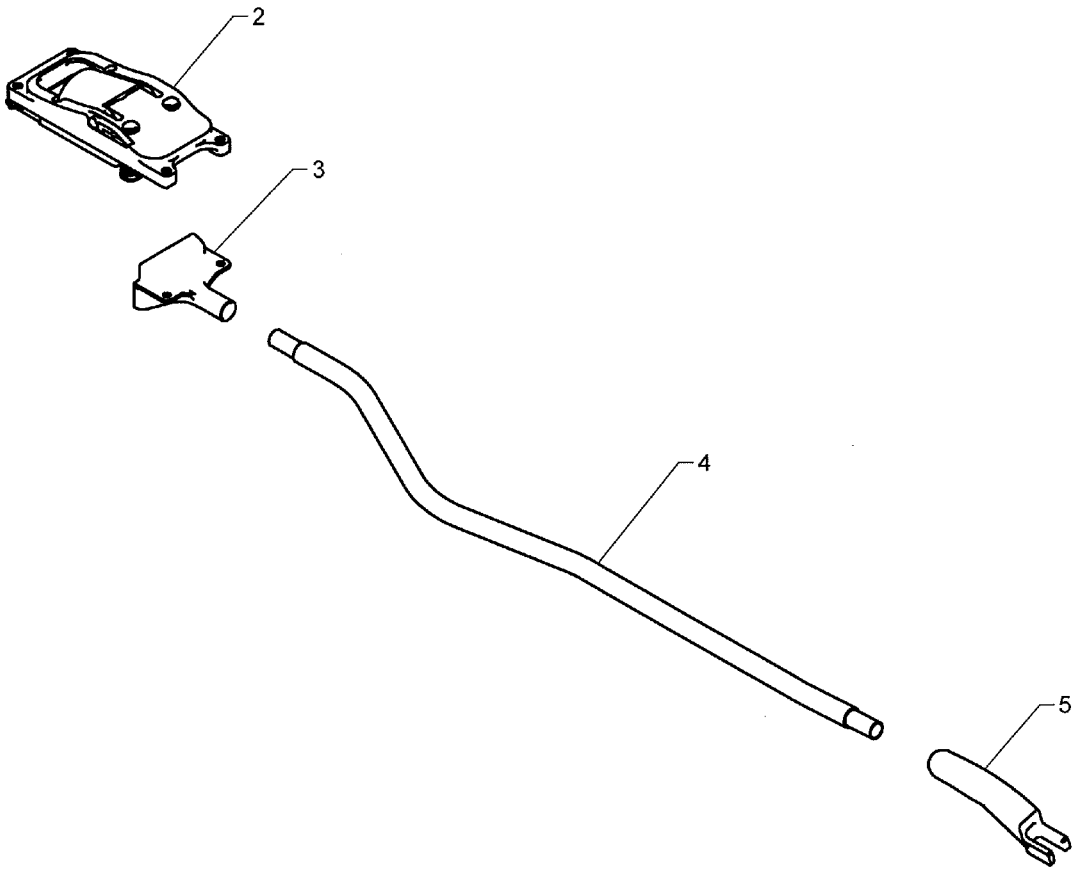
FIG. 5 shows one embodiment of various components of one embodiment of the AGRA assembly.

In connection with the improved penetrator configuration shown in FIG. 2, Applicant has also developed the AGRA assembly 1. One embodiment of the AGRA assembly is shown in FIGS. 3-5, and can be utilized in connection with the improved penetrator shown in FIG. 2. As shown generally in FIGS. 3-5, the AGRA assembly may contain an AGRA module 2, a forward arming wire manifold 3, arming wire conduit 4, and aft arming wire manifold 5. The AGRA module 2 will be described in more detail below. The forward arming wire manifold 3 provides a connection between the AGRA module 2 and the arming wire conduit 4. The arming wire conduit 4 provides a protected area to receive the arming wire that extends from the AGRA module 2 (and ultimately attached to a FZU 120), through the forward arming manifold 3, through the arming wire conduit 4, through the aft arming wire manifold 5, and into the fuze well 52. The aft arming wire manifold 5 provides a connection between the arming wire conduit 4 and the penetrator casing 21 that allows the arming wire to extend into the fuze well 52. The aft arming wire manifold 5 is preferably attached to the penetrator casing 21. The arming wire conduit 4 may also be attached to the penetrator casing 21 (for example by brackets or other attachment mechanisms), but it is not required.

The forward arming wire manifold 3 is preferably made of cast or machined aluminum, plastic or steel, but can be made of other materials that can withstand the forces and stresses of the general environments inherent to internal/external weapon carriage during ground operations and flight. The arming wire conduit 4 is preferably made of seamless stainless steel tubing but can also be made of other materials that can withstand the general environments inherent to internal/external weapon carriage during ground operations and flight. The aft arming wire manifold 5 is preferably made of cast or machined stainless steel, but can be made of other materials that can withstand the general environments inherent to internal/external weapon carriage during ground operations and flight.

As shown in FIGS. 3 and 4, the AGRA module 2 may be positioned near the middle of the penetrator 20. The AGRA module 2 may also be located in various other positions along the penetrator casing 21, but the preferred location is generally toward the middle. This placement facilitates use of the new penetrator design with existing deployment systems and mechanisms for penetrators. As shown in FIGS. 3 and 4, the AGRA module 2 can be completely external to the penetrator casing 21. In alternative embodiments, a recessed area, or depression, can be formed in penetrator casing 21 to allow the AGRA module 2 to have a lower profile as compared to having the AGRA module 2 sit on the outside of a standard penetrator casing 21. In the preferred embodiments, the penetrator casing 21 does not have any holes (used to secure the AGRA module 2 to the penetrator casing 21) that penetrate to the internal portion where the explosive materials are located.

Figure 6A:
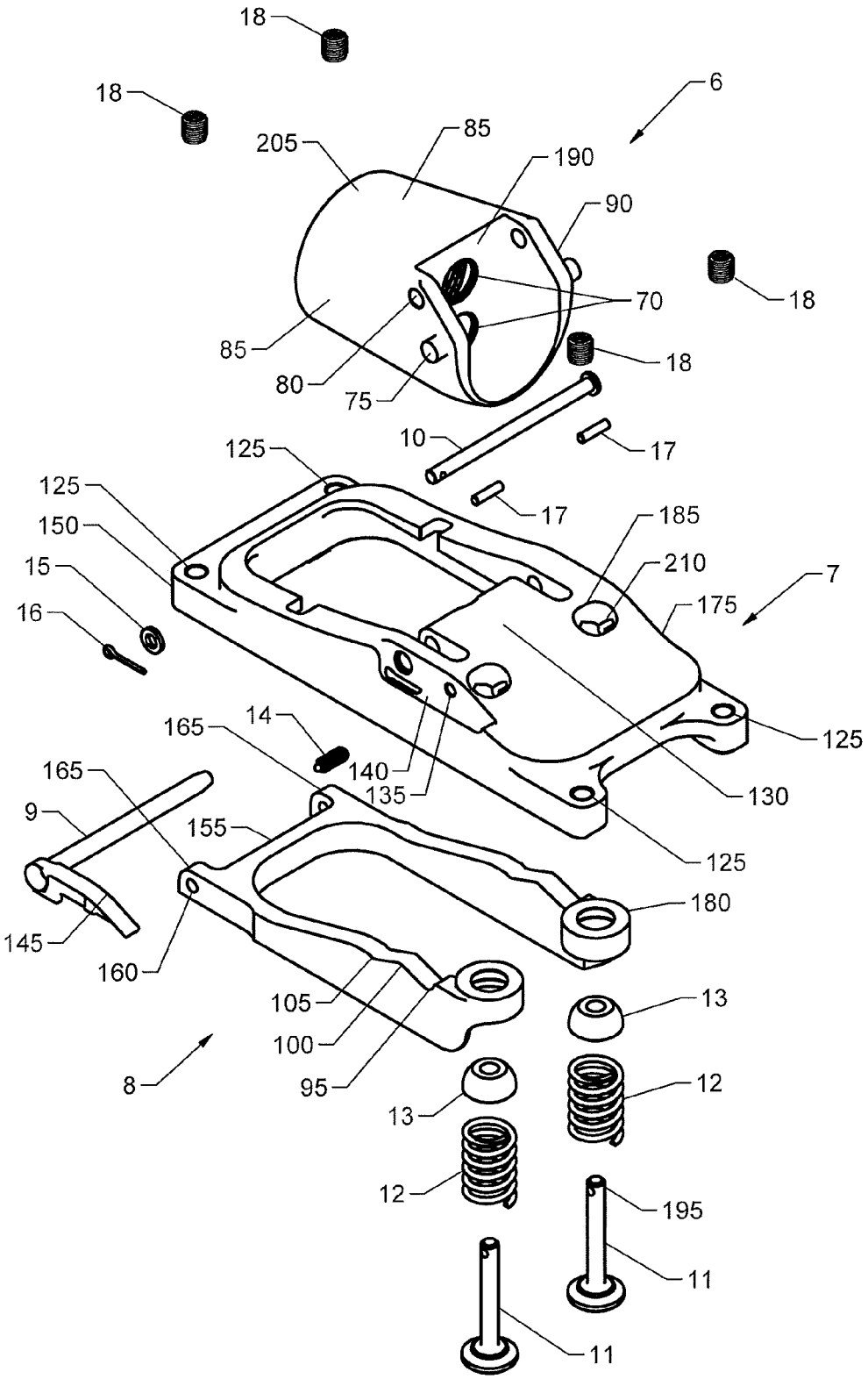
FIG. 6A shows one embodiment of the AGRA module.
Figure 6B:
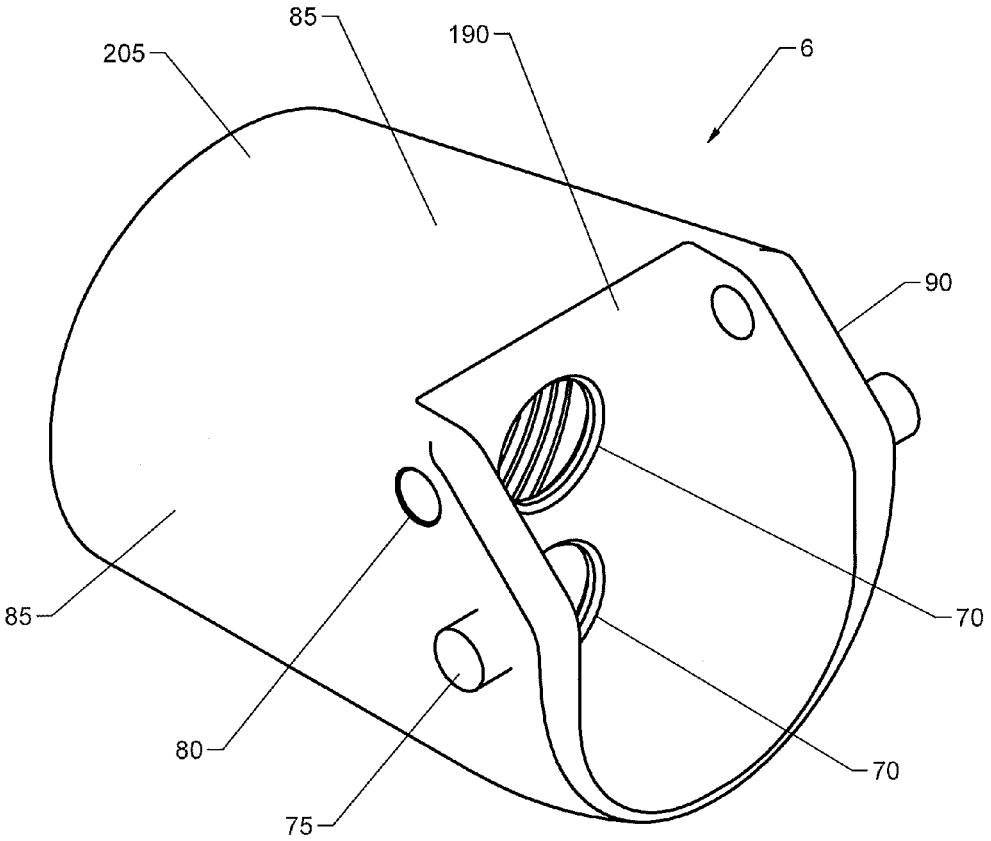
FIG. 6B shows a closer view of the FZU adaptor in FIG. 6A.
Figure 6B:
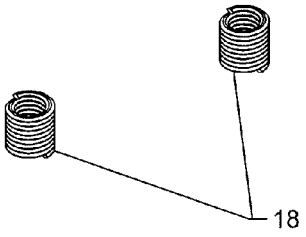
Figure 6C:
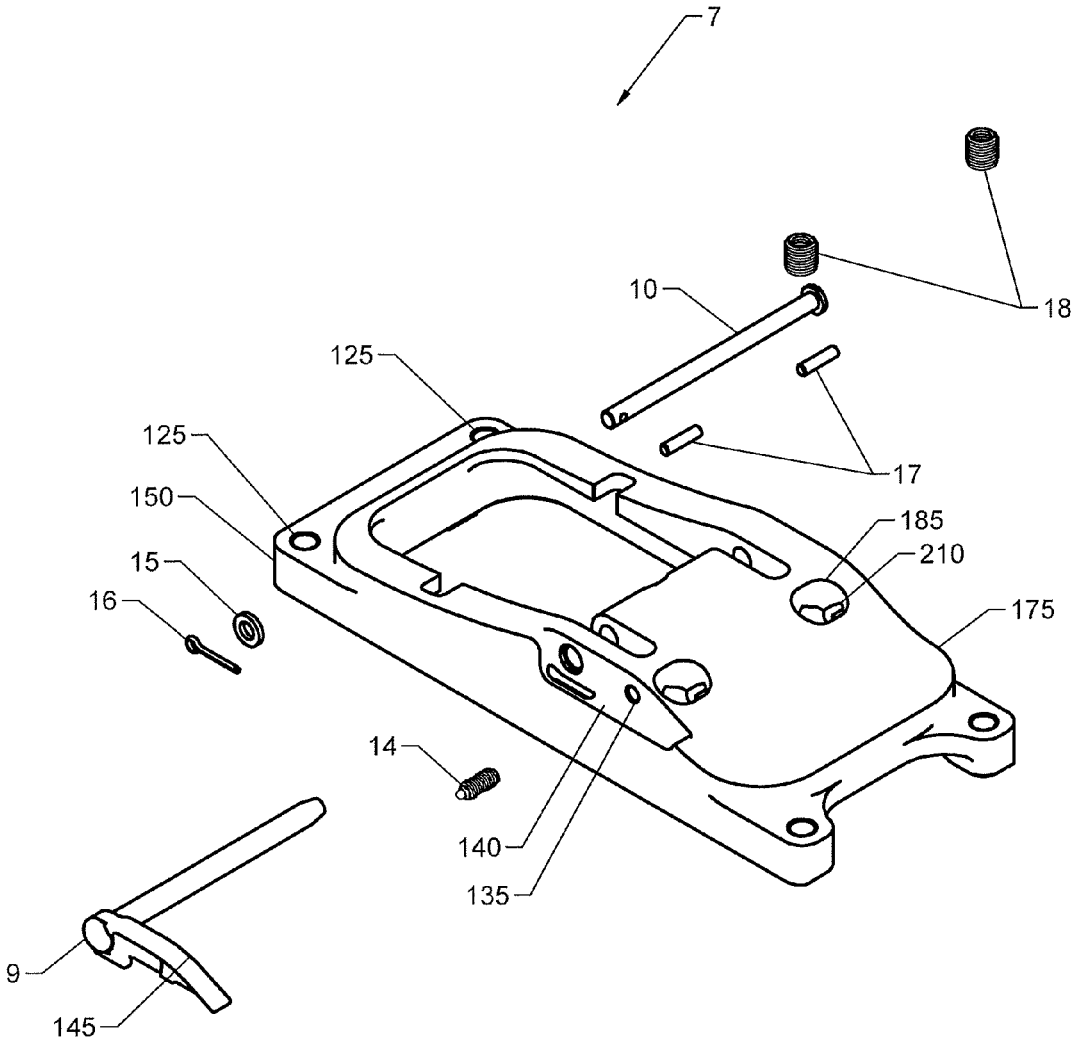
FIG. 6C shows a closer view of the chassis and associated components in FIG. 6A.
Figure 6D:
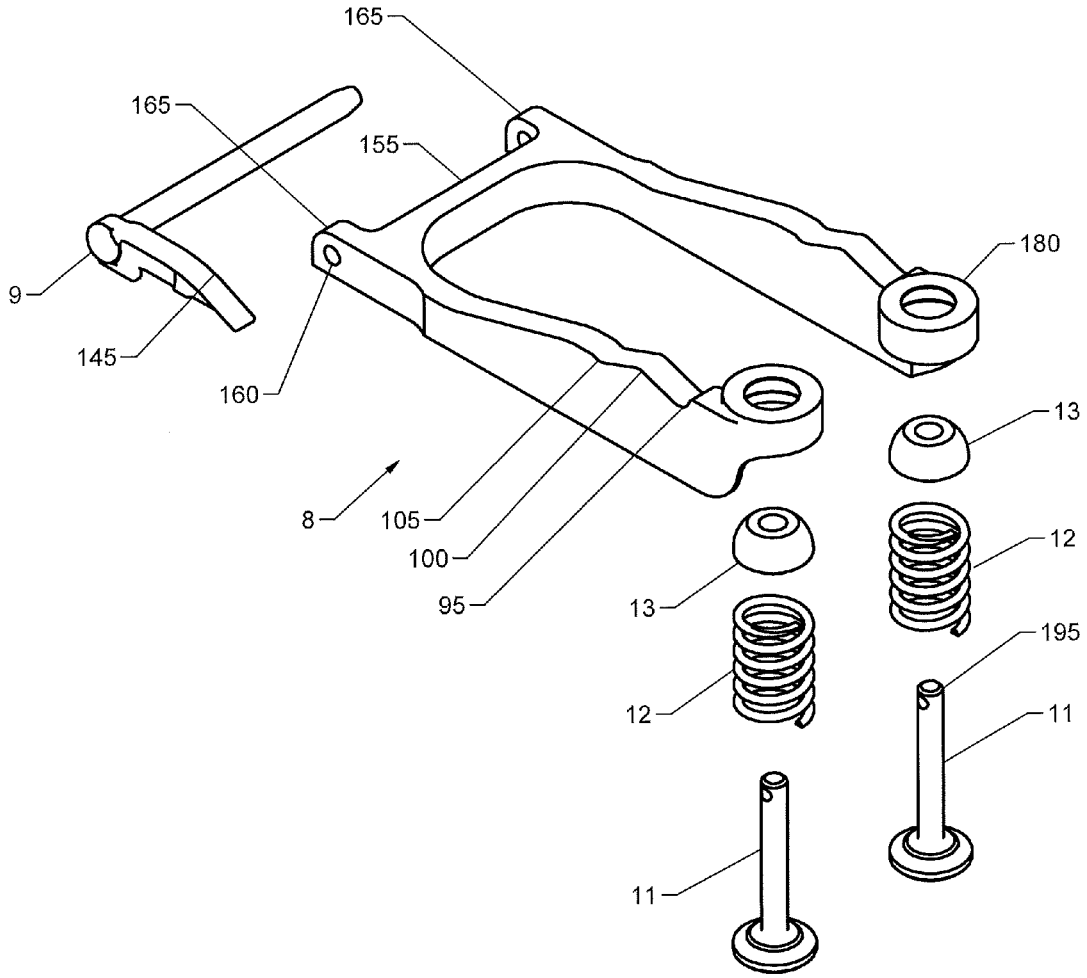
FIG. 6D shows a closer view of the cam arm and associated components in FIG. 6A.
Figure 7:
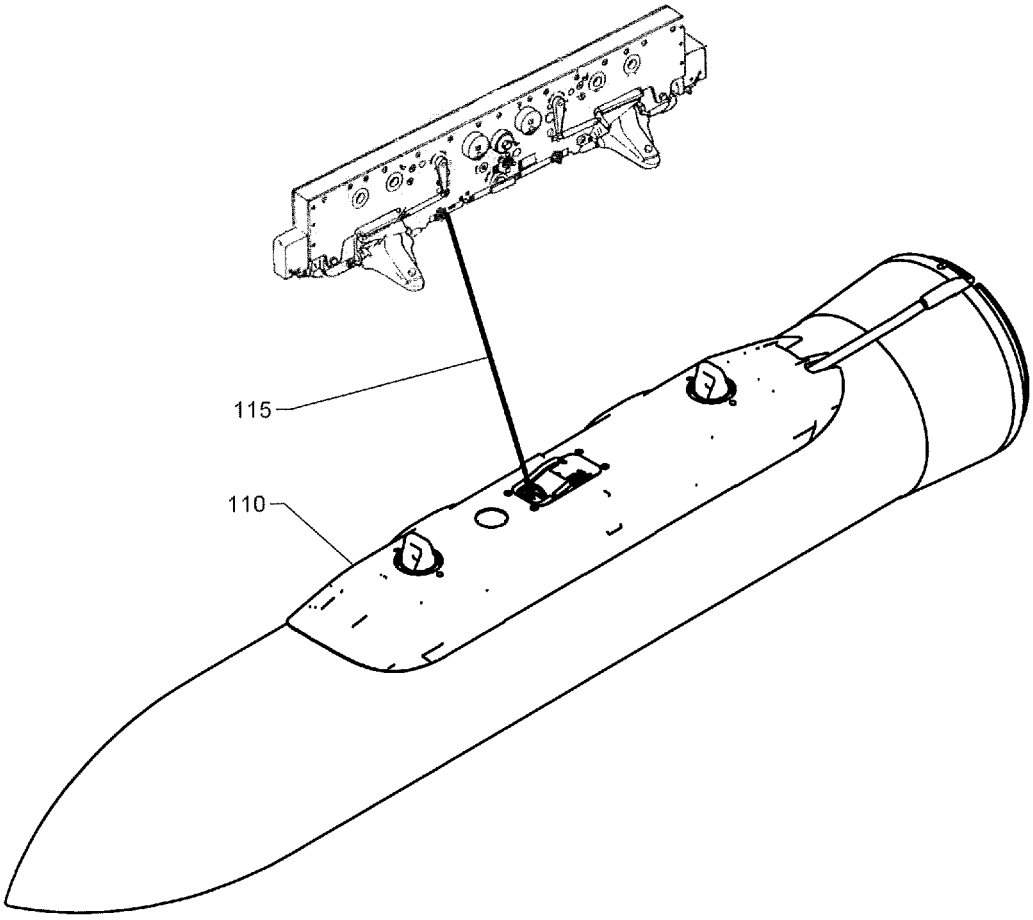
FIG. 7 shows a view of one embodiment of the AGRA module, in a closed, or stowed position, being triggered by a lanyard upon release of the penetrator from its attachment or deployment system.
Figure 19:
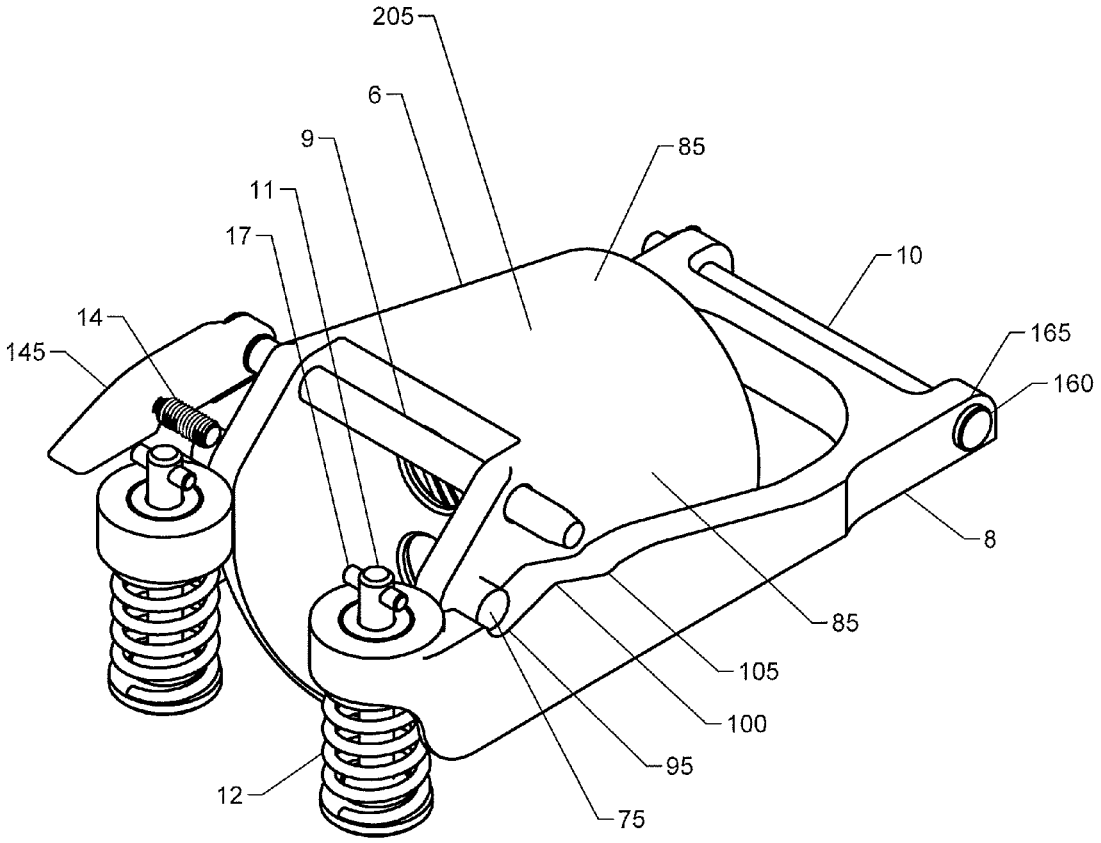
FIG. 19 is a partial perspective view of one embodiment of the AGRA module with the chassis removed.

Referring to FIG. 6A, one exploded view of one embodiment of the AGRA module 2 is shown. In this embodiment, the AGRA module 2 may include one or more of the following: an FZU adaptor 6, chassis 7, cam arm 8, safety pin hinge 9, cam hinge pin 10, one or more spring pins 11, one or more springs 12, one or more spring cups 13, detent spring pin 14, washer 15, cotter pin 16, one or more spring pin retaining pins 17, and one or more locking helical threaded inserts 18. The FZU adaptor 6 can be made of any suitable material, but is preferably made of stainless steel. Similarly, the chassis 7 and cam arm 8 can be made of any suitable material, including stainless steel, but are preferably made of aluminum. Additional views of the AGRA module 2 (or components thereof) are shown in FIGS. 6B-6D, 12-18, and generally shown in its stowed, or closed, position. FIG. 19 is an additional view of some of the components of the AGRA module 2, namely the FZU adaptor 6, cam arm 8, spring pins 11, springs 12, spring pin retaining pin 17, safety hinge pin 9, and cam hinge pin 10.

Referring to FIGS. 6A, 6B, 10, 11, 15, and 16, the FZU adaptor 6 may have a generally circular internal cross section, and contain a cavity 65. The cavity 65 may be threaded to receive a FZU 120. The bottom of the FZU adaptor 6 may also have FZU adaptor holes 70 to accommodate arming wire that can be attached to the FZU 120 when inserted into the cavity 65.

Referring generally to FIG. 6A, in one embodiment of the AGRA module 2, the chassis 7 and cam arm 8 are connected, and with the help of the other components described, provide a partial housing for the FZU adaptor 6. The FZU adaptor 6 may have FZU adaptor pins 75 on its exterior surface that can be seated in a channel formed between the interface of the chassis 7 and cam arm 8. The cam arm 8 may have a series of ridges and depressions to allow for multiple orientations of the FZU adaptor 6 via the FZU adaptor pins 75 in different locations along the channel. For example, the cam arm 8 may have a stowed recess position depression 95 designed and configured to receive the FZU adaptor pins 75 when the FZU adaptor 6 is in a stowed position (in a generally horizontal orientation as shown in FIGS. 12-18). As the FZU adaptor 6 moves from the stowed position to the open position (which can be in a vertical orientation, or some other position different from the stowed position), the FZU adaptor pins 75 can move from the stowed recess position depression 95, over a dividing ridge 100, and into an open recess position depression 105.

Figure 8:
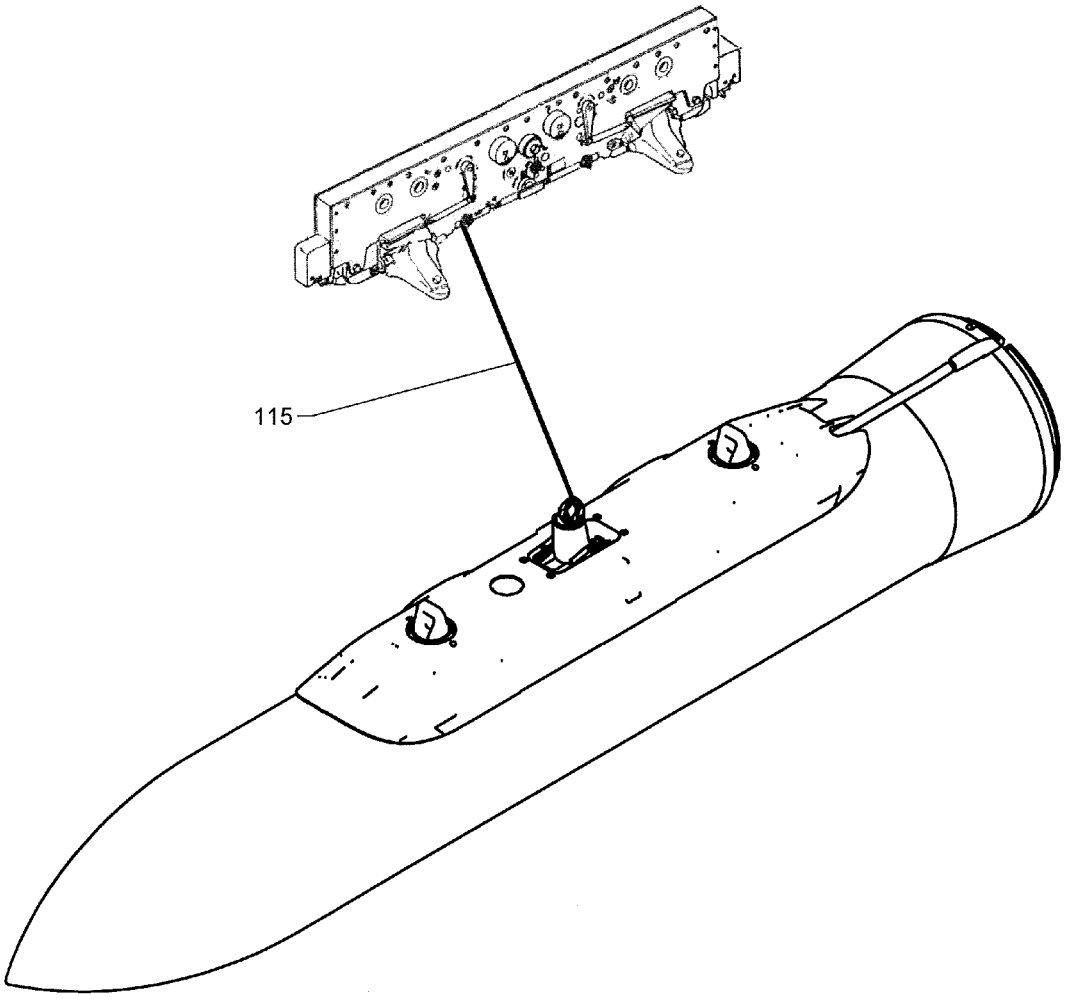
FIG. 8 shows another view of the AGRA module of FIG. 7 after being triggered, in its open position.
Figure 9:
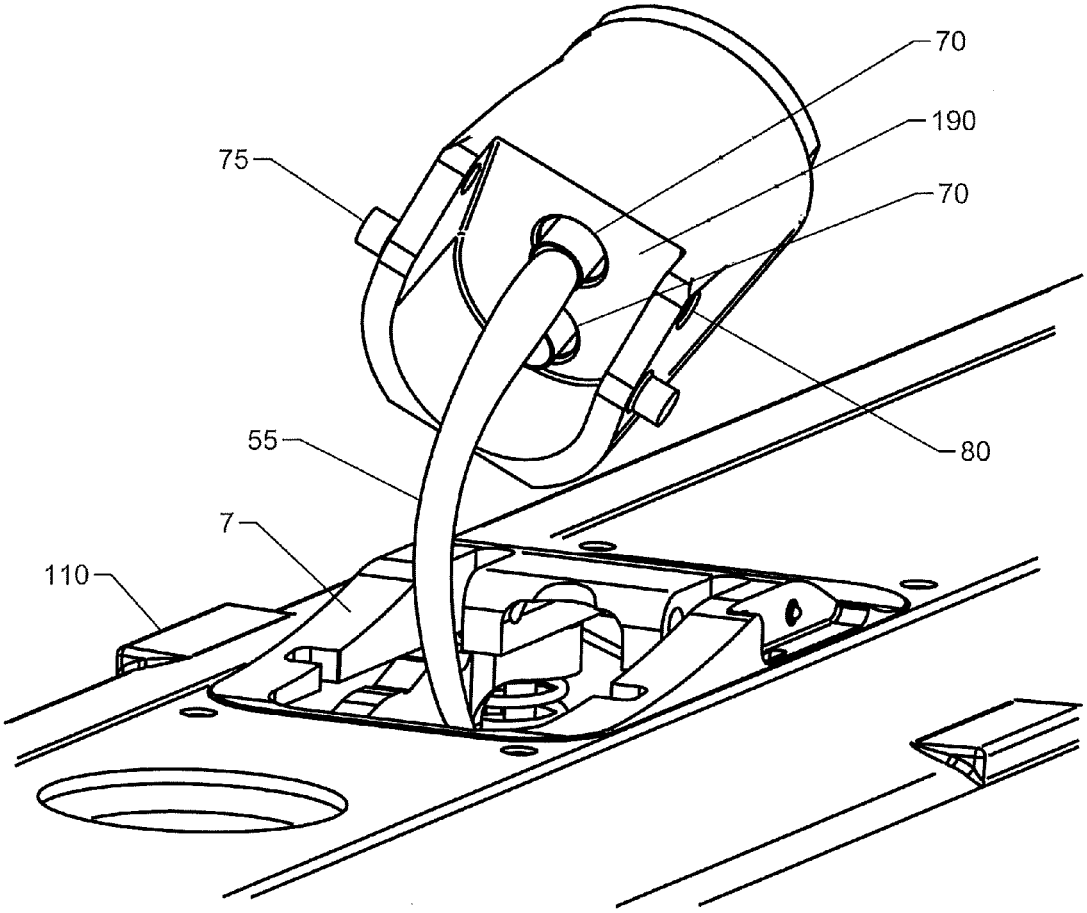
FIG. 9 shows a close up of one embodiment of the FZU adaptor removed from the AGRA module showing the arming cable interface.
Figure 10:
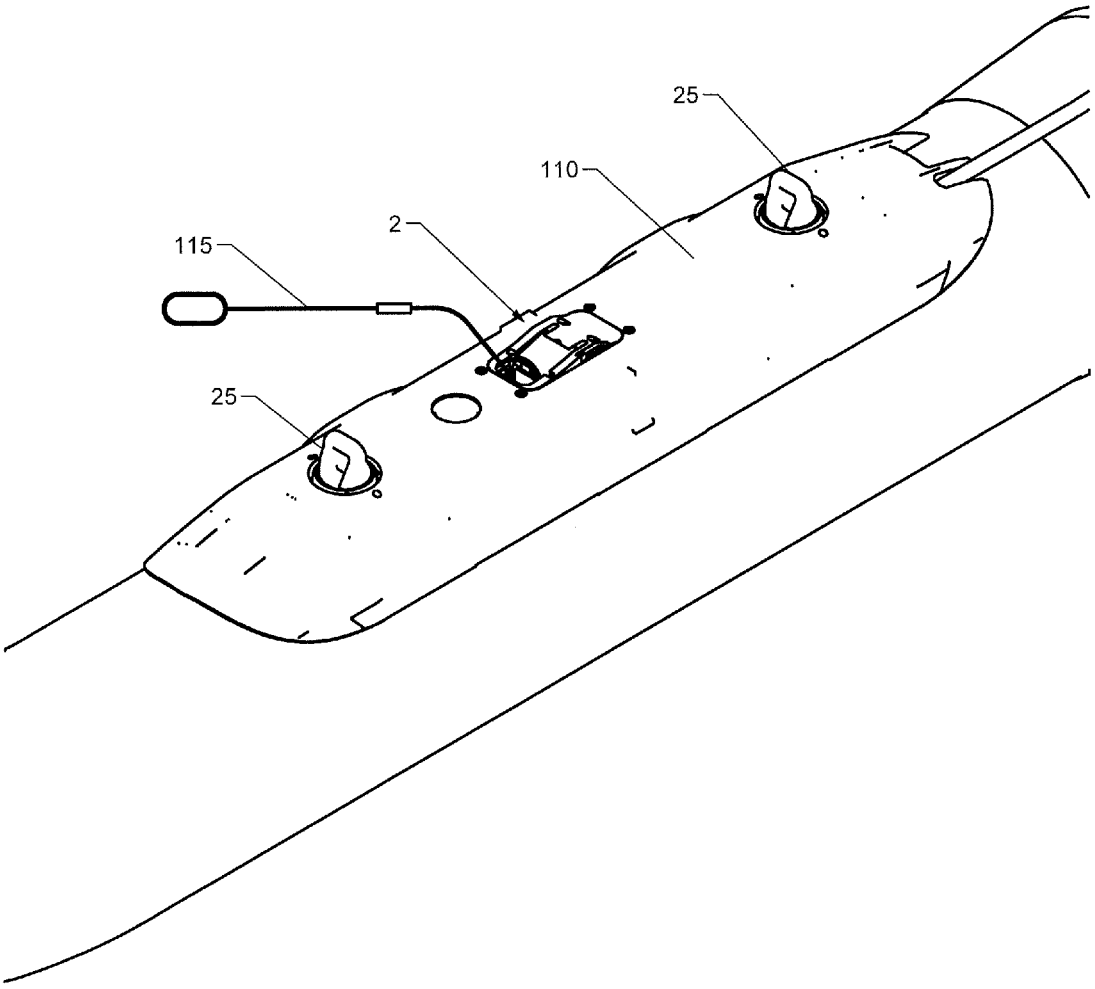
FIG. 10 shows one embodiment of the AGRA module in its stowed configuration, and surrounded by a hardback.
Figure 11:
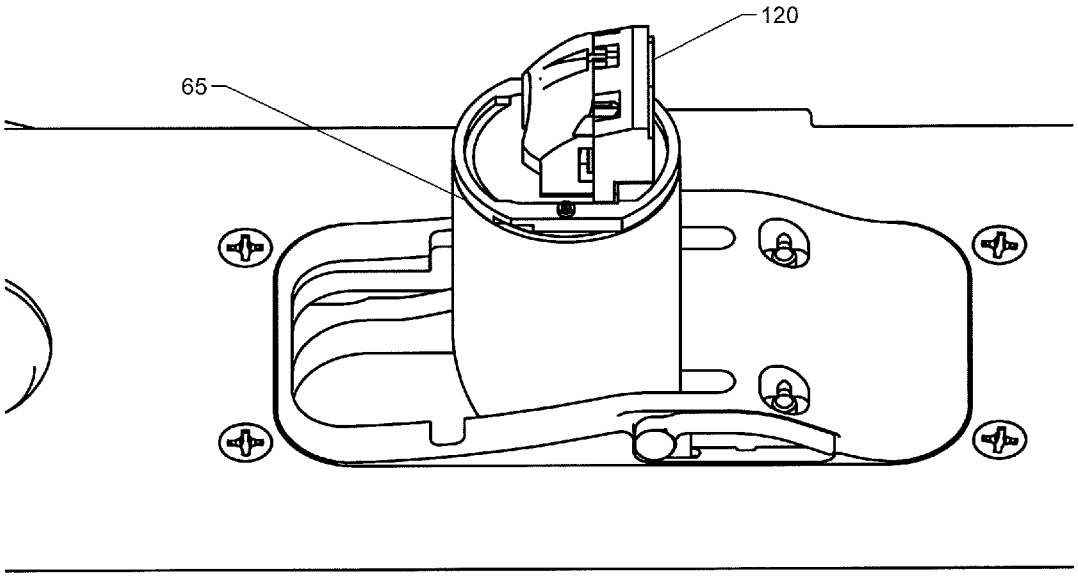
FIG. 11 shows one embodiment of the AGRA module in its deployed configuration, and having an inserted FZU.
Figure 12:
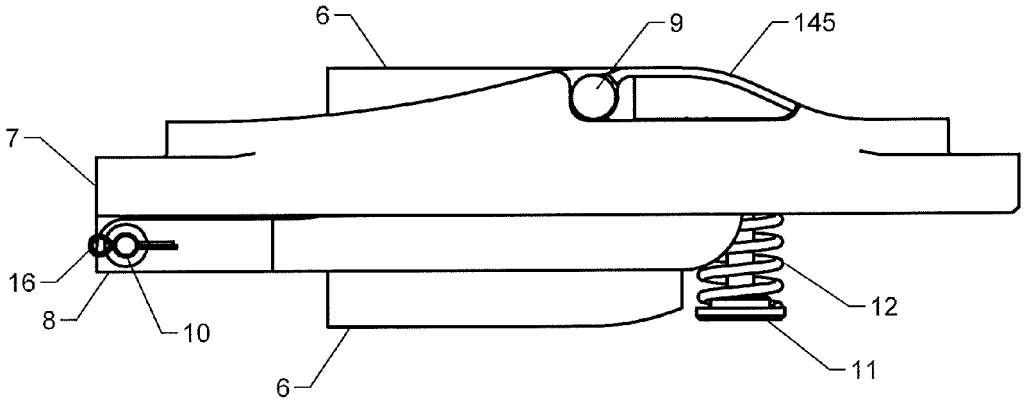
FIG. 12 is a side view of one embodiment of the AGRA module in its stowed (or closed) position.
Figure 13:
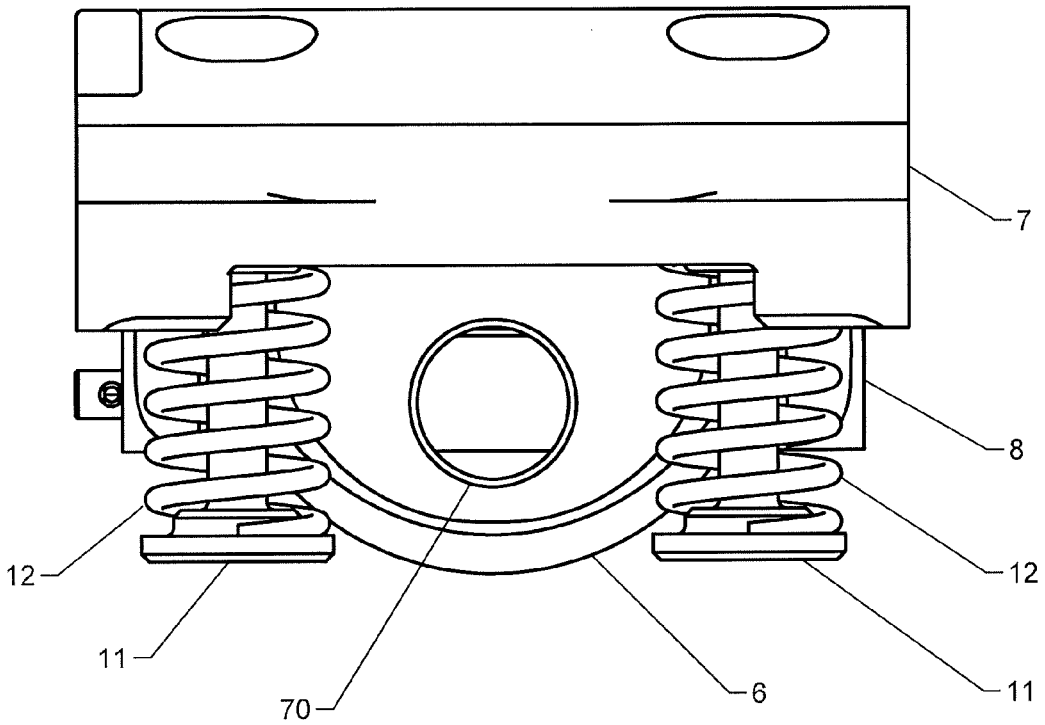
FIG. 13 is a back view (or aft end) of one embodiment of the AGRA module in its stowed position.
Figure 14:
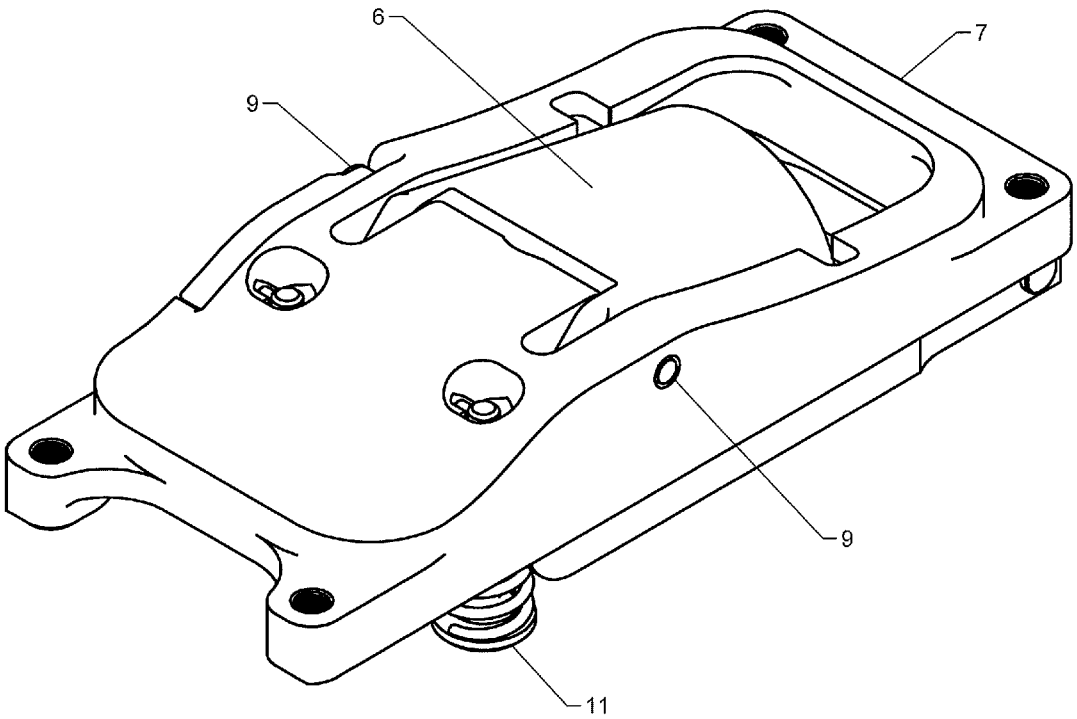
FIG. 14 is a perspective top view of one embodiment of the AGRA module in its stowed position.

The springs 12 and spring pin 11 provide an upward force that generally keeps the FZU adaptor 6 in a closed/stowed position when the FZU adaptor pins 75 are in the stowed recess position depression 95. When sufficient force is applied to the FZU adaptor 6, it pulls the FZU adaptor 6 into an open position (as shown in FIGS. 8 and 11), causing the FZU adaptor 6 to rotate about the safety hinge pin 9 and moving the FZU adaptor pin 75 over the dividing ridge 100 and into the open recess position depression 105. With the springs 12 and spring pin 11 continuing to provide an upward force, once in the open position, the FZU adaptor 6 remains in the open position.

In some embodiments, the safety hinge pin 9 acts to further connect and attach the FZU adaptor 6 to the chassis 7. The safety hinge pin 9 can be received through openings in the side of the chassis 7 (or other location), FZU adaptor hinge pin holes 80, and corresponding holes in the chassis center arm 130. The safety hinge pin 9 may also have a hinge pin arm 145. The chassis 7 may also have a spring biased detent spring pin 14, located in a detent spring pin hole 135, that protrudes from the chassis 7 such that when the safety hinge pin 9 is in place and the hinge pin arm 145 rotated into the safety hinge pin arm shelf 140, the arm 145 depresses the detent spring pin 14, at least partially into the body of the chassis 7. The hinge pin arm 145 face that engages the detent spring pin 14 may also have a recess into which the detent spring pin 14 can be seated when the hinge pin arm 145 is rotated into the safety hinge pin arm shelf 140. The detent spring pin 14 acts upon the safety hinge pin arm 145 so as to maintain its position unless manually unlocked for removal.

As described above, when in its stowed position, the FZU adaptor pins 75 are generally in the stowed recess position depression 95. When force is applied and the FZU adaptor 6 moved toward an open position, the FZU adaptor 6 rotates about the axis of the safety hinge pin 9, moving the FZU adaptor pin 75 toward the chassis forward end 150 and cam arm forward end 155, over the dividing ridge 100, and into the open recess position depression 105. In the embodiments where the springs 12 and spring pins 11 are used, a relatively significant amount of force is required to move the FZU adaptor 6 from the stowed position to the open position. In other words, the springs 12 and spring pins 11 (described further below), and the connection between the chassis 7 and cam arm 8, tend to keep the FZU adaptor 6 in place. The force required to move the FZU adaptor 6 to the open position most overcome the force applied by the springs 12 and move the FZU adaptor pin 75 from the stowed recess position depression 95, over the dividing ridge 100, and into the open recess position depression 105. The weight of the penetrator 20 pulling on the lanyard 115 (still attached to the deployment system) is sufficient to move the FZU adaptor 6 to the open position. Once in the open recess position depression 105, due to the continuing force applied by the springs, the FZU adaptor 6 remains in this orientation. When the FZU adaptor 6 is in its open position, the FZU adaptor engaging face 190 can rest against the chassis center arm 130 to stop the rotation of the FZU adaptor 6. Additionally, in its open position, the FZU adaptor pin 75 may also engage the underside of the chassis 7 to help prevent further rotation.

When the FZU adaptor 6 is in its stowed position, and the FZU adaptor pins 75 located in the stowed recess position depression 95, the FZU adaptor pins 75 may also rest against the underside of the chassis 7. This point of contact keeps the FZU adaptor 6 from further rotation relative to the chassis 7, and can help maintain the desired orientation (substantially horizontal in the figures).

The chassis 7 may have a recessed area on the underside to receive portions of the cam arm 8, if the embodiment uses both the chassis 7 and cam arm 8 components. It should be recognized that various configurations could be used, including combining the chassis 7 and cam arm 8 into a single component, or changing the location and configuration of the "depressions" and "ridges" in which the FZU adaptor pins 75 may be seated. Preferably, the width of the cam arm 8 is smaller than the width of the peripheral edge of the chassis 7. In a preferred embodiment, the openings (used to accommodate the springs 12 and spring pin 11) on the cam arm rest against the underside of the corresponding openings in the chassis 7 (also used to accommodate the springs 12 and spring pin 11), and the stowed recess position depression 95, dividing ridge 100, and open recess position depression 105 form the referenced channel on the underside of the chassis 7.

In general use, the FZU adaptor 6 is normally in its stowed position when the penetrator is attached to its deployment system, for example, the undercarriage of an aircraft. To facilitate connection to its deployment system, in some embodiments, the penetrator may also include a hardback 110 that covers at least a portion of the penetrator 20. The hardback 110 may cover the areas in which the AGRA module 2, forward arming wire manifold 3, portions (or all) of the arming wire conduit 4, and the suspension lugs 25 are located. However, the hardback 110 preferably has openings above the location of the AGRA module 2 to allow connection between the AGRA module 2 and lanyard, to allow the AGRA module 2 to be deployed from its stowed position to an open position (see FIGS. 7 and 10 as examples). The hardback 110 may also have openings to accommodate the suspension lugs 25, which can extend through the hardback 110 openings. The hardback 110 can be made of any suitable material, but is preferably made of aluminum, and provides some protection against damage to the AGRA module 2 (and other components) when the penetrator 20 is being moved, stored, and/or loaded onto its deployment system. The hardback 110 may also facilitate and include components to allow attachment to the deployment system itself. The AGRA module 2 may be attached directly to the hardback 110 rather than to the penetrator itself.

The deployment system will often include a lanyard 115 connected to a FZU 120. The FZU may be inserted into the FZU adaptor cavity 65, and secured. In some embodiments, the FZU 120 is threaded, and screwed into the FZU adaptor 6, using the threaded FZU cavity 65. When the penetrator 20 is disengaged from the deployment system, the lanyard 115 remains connected to the deployment system, or the structure holding the deployment system (for example, the undercarriage of an aircraft). As such, when the lanyard 115 pulls tight, the force causes the FZU 120 and FZU adaptor 6 to rotate and move into an open position. As the FZU 120 and FZU adaptor 6 are pulled into the open position, the FZU 120 is triggered, through the arming wires, and arms the penetrator through the fuze well 52, as is known and understood by those of skill in the art. Once armed, the penetrator will detonate as designed (e.g., on impact or other condition).

The FZU adaptor 6 may include any number of flat faces 85 on the exterior of the FZU adaptor 6. As used herein, a "flat face" may refer to a portion of the exterior of the FZU adaptor 6 having a flat portion. Thus, if the FZU adaptor 6 has in internal circular cross section, some portions of the exterior surface of the FZU adaptor 6 may have the same circular shape, while others might be flat. In a preferred embodiment, the sides of the FZU adaptor 6, and the top surface 205 preferably have flat faces 85. These flat faces 85, if used, may facilitate the flush configuration of the FZU adaptor 6 when its stowed position, and/or allowing the FZU adaptor to move through the large opening of the chassis 7 through which it rotates between the open and stowed positions. The FZU adaptor holes 70, preferably in the bottom of the FZU adaptor 6, allow for the arming wires or other electronic and signaling connections to be connected to the FZU 120 that may be seated in the FZU adaptor cavity 65. In a preferred embodiment, the FZU adaptor 6 top surface 205 (when in its stowed position) has a flat face, and is substantially flush with the chassis center arm 130.

The AGRA module 2 may also have securing holes 125 that allow the AGRA module 2 to be secured to the penetrator casing 21, hardback 110, or other structure. The securing holes 125 can be threaded or smooth. In one embodiment, the AGRA module 2 is secured to the penetrator casing 21, but the holes in the penetrator casing do not pass all the way through the penetrator casing 21 to maintain superior structural integrity of the penetrator casing 21. In other embodiments, the holes in the penetrator casing 21 can extend into the interior of the penetrator casing 21. If the AGRA module 2 is attached to the hardback 110 (which in turn is connected to the penetrator 20), no holes are necessary in the penetrator casing 21 to receive the AGRA module 2 directly. The AGRA module 2 can be secured to the penetrator casing 21 or hardback 110 using any conventional methods or attachment mechanisms, including bolts or screws. In alternative embodiments, the AGRA module 2 can also be welded to the penetrator casing 21 or hardback 110, or formed integral with the penetrator casing 21 or hardback 110.

Figure 15:
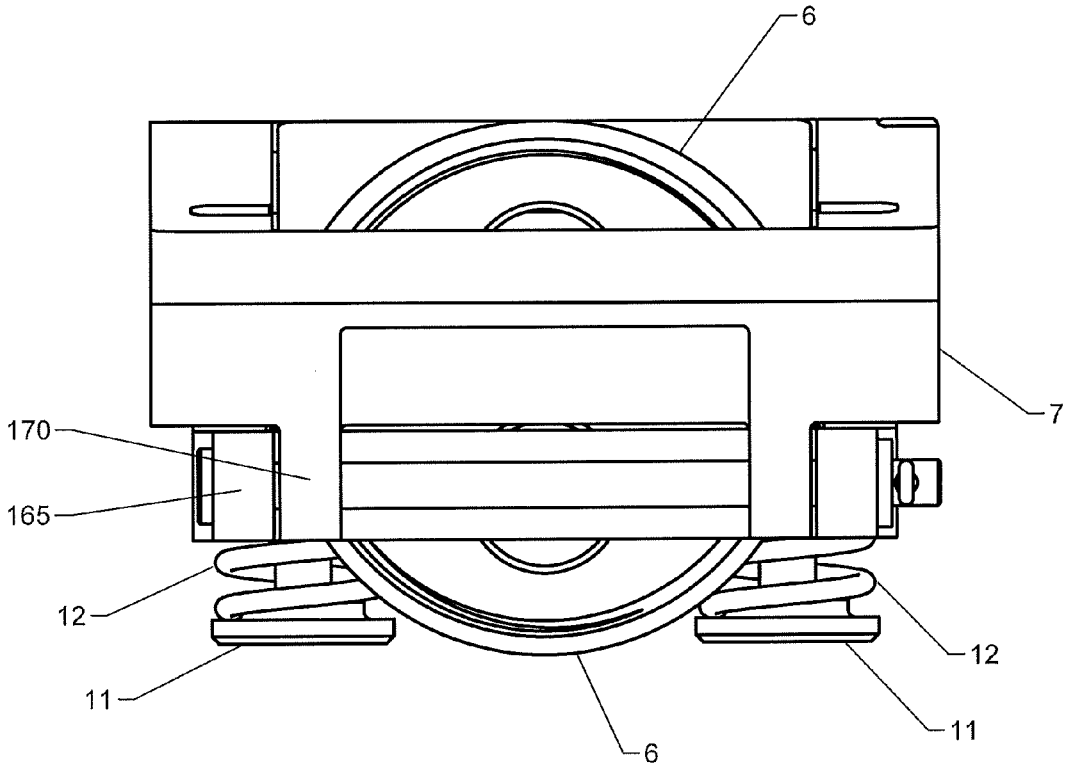
FIG. 15 is a front view (or forward end) of one embodiment of the AGRA module in its stowed position.
Figure 16:
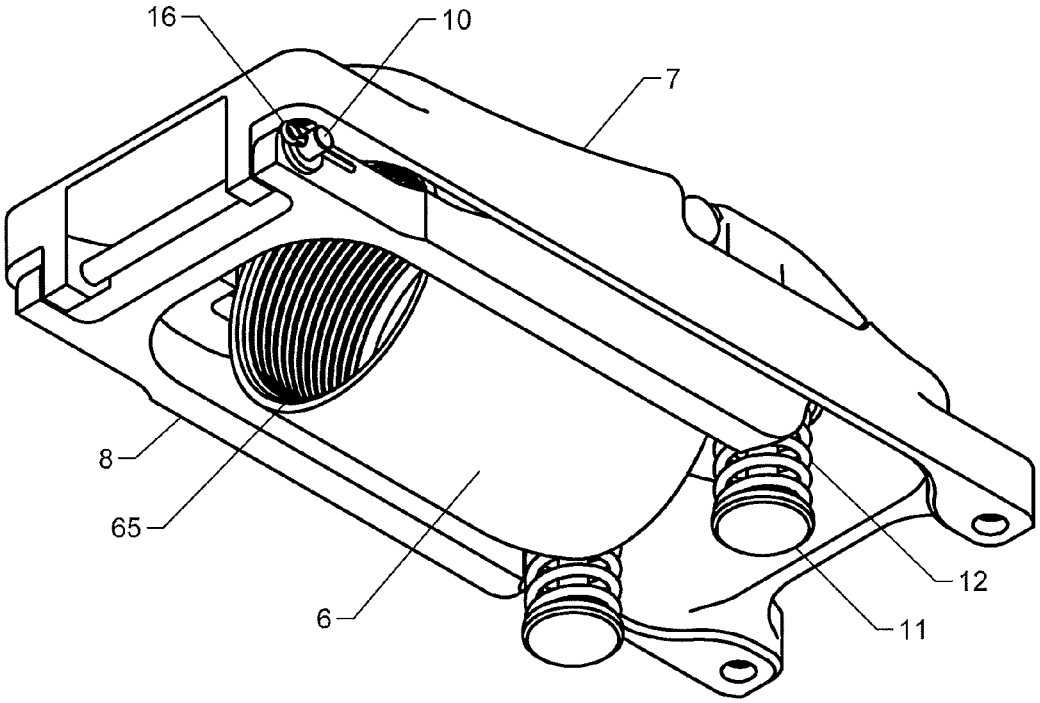
FIG. 16 is a perspective bottom view of one embodiment of the AGRA module in its stowed position.
Figure 17:
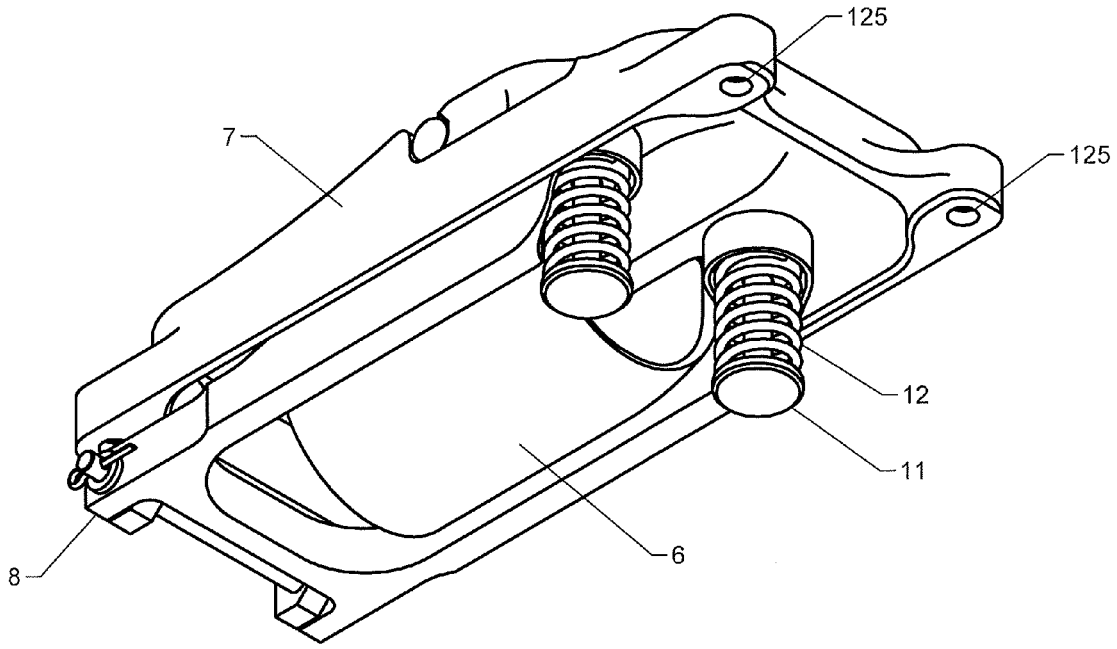
FIG. 17 is a perspective bottom view of one embodiment of the AGRA module in its stowed position.
Figure 18:
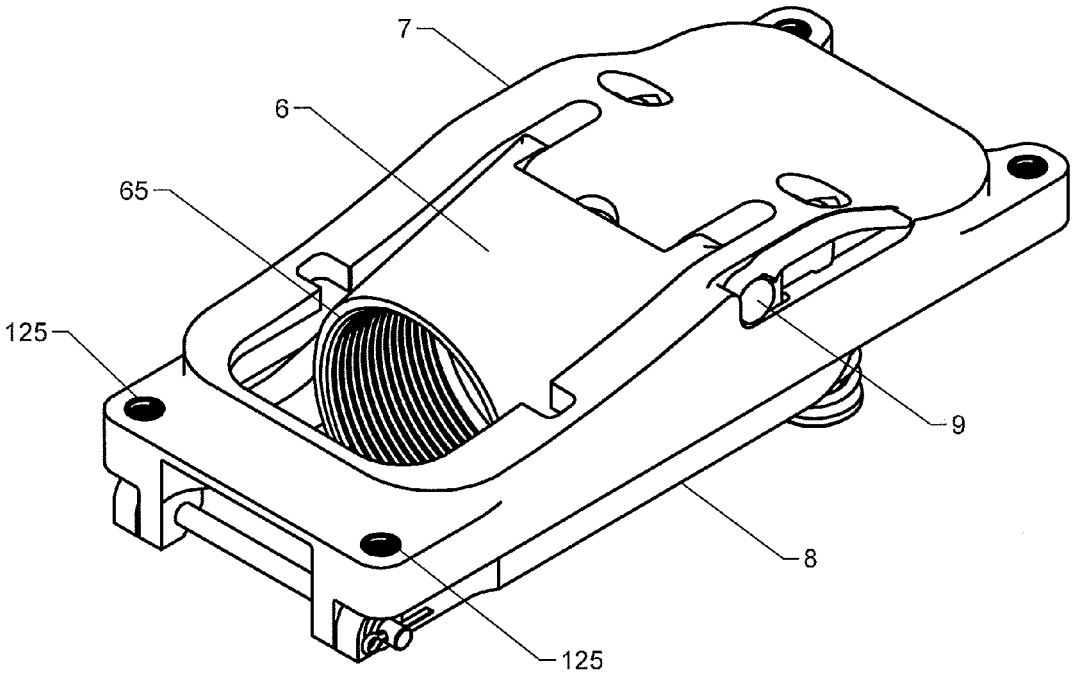
FIG. 18 is a perspective top view of one embodiment of the AGRA module in its stowed position.

In some embodiments, the cam hinge pin 10 can be used to connect the chassis forward end 150 and the cam arm forward end 155. It should be noted that chassis "forward end" 150 and cam arm "forward end" 155 are used in reference to the drawings as depicted. In use the referenced "forward end" is actually farther from the front of the penetrator. The chassis 7 and cam arm 8 can have openings 160 (the openings 160 in the chassis 7 are not shown in FIG. 6(A) because they are on the underside of the chassis 7) passing through the chassis forward end 150 and cam arm forward end 155 to allow the cam hinge pin 10 to pass through, and secure the components together. FIG. 19 shows the cam hinge pin 10 passing through the openings 160 of the cam arm 8 (without the chassis 7). The cam arm forward end 155 may include forward extensions 165 that contain the openings 160 to receive the cam hinge pin 10. Similarly, the chassis 7 may have downward extensions 170 (shown in FIG. 15) that contain the openings 160 to receive the cam hinge pin 10. As shown in FIG. 15, the forward extensions 165 of the cam arm 8 may be placed on the outside of the downward extensions of the chassis 7, and the cam hinge pin 10 inserted, connecting the cam arm 8 and chassis 7 at their respective forward ends 155, 150. The cam hinge pin 10 may be used in conjunction with a washer 15 and cotter pin 16 to secure the cam hinge pin 10 in place. As would be recognized by those of skill in the art, other means to secure the cam arm 8 and chassis 7 together can be used, including bolts or other common securing mechanisms. Alternative configurations of the chassis 7 and cam arm 8 are obviously possible, including use of a single component. Generally, the desired structure allows the FZU adaptor to have one or more positions that allow the FZU to be triggered at the desired time.

In some embodiments, the spring pin 11 may extend through openings in the cam arm 8 and chassis 7, and with the springs 12, spring cups 13, and spring pin retaining pin 17, hold the chassis aft end 175 and cam arm aft end 180 together. The chassis 7 may also have a recess 185, used together with the opening of the chassis 7, to allow the leading end 195 of the spring pins 11 to be seated below the top of the chassis 7 when in use. The leading end 195 of the spring pin may have an additional spring pin retaining pin 17 that passes through the spring pin 11 (forming a "T" shaped) so the spring pin 11 stays in place. Using this configuration allows the spring pin 11 to be pushed upwardly, exposing the leading end 195 of the spring pin retaining pin 17 as it moves up and out of the recess 185. If the spring pin retaining pin 17 is removed, the spring pin 11 can be removed and the chassis 7 and cam arm 8 disconnected (at least at this connection point). In a preferred embodiment, the recess 185 may have a lip 210 to engage the spring pin retaining pin 17. The recess 185 (and openings in the cam arm 8 and chassis 7) may also be configured such that the spring pin 11 and spring pin retaining pin 17 can be removed without removing the spring pin retaining pin 17 from the spring pin 11. For example, the recess 185 (and openings in the cam arm 8 and chassis 7) can have a narrow channel that is long enough and wide enough such that when properly rotated, the spring pin retaining pin 17 can slip through the channel, but when rotated, the spring pin retaining pin 17 rests on the lip 210. Other means to securing the spring pin 11 can obviously be used, and would be appreciated by those of skill in the art. Additionally, other means for securing the aft ends together can be used.

The AGRA module 2 enables the FZU 120 to be rotated 90 degrees or more in order to minimize the profile of the assembly outside the warhead casing, and upon weapon release allows the FZU 120 to be rotated to an optimal position 90 degrees (or other desired orientation) relative to its stowed position, positioning the FZU 120 in the correct orientation for activation and air flow. Activation and positioning of FZUs 120 are known and understood by those of skill in the art and not repeated here. Activation of the FZU 120 may be by any means known to those of skill in the art. By using the AGRA module 2, the FZU 120 no longer needs to be mounted inside the penetrator (or warhead), nor do its arming wires need to travel through the interior of the penetrator/warhead.

What is claimed is:

1. A FZU mounting module comprising:

a. a chassis having a forward end, an aft end, a center arm, and openings configured to receive an adaptor pin;

b. a cam arm connected to the chassis, said cam arm having a forward end, an aft end, first recess position depression, second recess position depression, and dividing ridge between the first recess position depression and second recess position depression; and c. a FZU adaptor comprising a cavity, openings to receive a safety hinge pin, and at least one FZU adaptor pin on the FZU adaptor exterior, wherein the FZU adaptor is connected to the chassis by a safety hinge pin through its openings, wherein the FZU adaptor is rotatable about the axis of the safety hinge pin, and wherein the FZU adaptor pin is moveable between the cam arm first recess position depression and second recess position depression when the FZU adaptor is moved from a stowed position to an open position.

2. The FZU mounting module of claim 1 wherein the FZU adaptor cavity is threaded.

3. The FZU mounting module of claim 2 wherein the FZU adaptor further comprises adaptor holes in the bottom of the FZU adaptor to receive arming wires.

4. The FZU mounting module of claim 1 wherein the chassis has securing holes at its forward end and aft end.

5. The FZU mounting module of claim 1 wherein the forward end of the chassis and the forward end of the cam arm are connected, and wherein the connection between the aft end of the chassis and aft end of the cam arm comprises springs and spring pins.

6. The FZU mounting module of claim 1 wherein the FZU adaptor is rotatable at least 90 degrees, and wherein the FZU adaptor is substantially horizontal in a stowed position and substantially vertical in an open position.

7. The FZU mounting module of claim 1 wherein the FZU mounting module is secured to a penetrator hardback.

8. The FZU mounting module of claim 1 further comprising a fuze arming generator seated in the FZU adaptor cavity.

9. A FZU mounting module comprising:

a. a chassis;

b. a cam arm connected to the chassis;

c. a FZU adaptor comprised of a cavity configured to receive a fuze arming generator and at least one FZU adaptor pin on its exterior surface, wherein the FZU adaptor is attached to the chassis and is rotatable about an axis defined by the connection between the chassis and FZU adaptor, and wherein the FZU adaptor pin is seated in a channel formed between the connection between the chassis and cam arm.

10. The FZU mounting module of claim 9 wherein the internal cross section of the FZU adaptor cavity is circular in shape and threaded.

11. The FZU mounting module of claim 9 wherein the cam arm comprises a first recess position depression and a second recess position depression, and wherein the FZU adaptor pin is seated in the first recess position depression in a stowed position and the second recess position depression in an open position.

12. The FZU mounting module of claim 9 wherein the connection between the chassis and cam arm comprises springs and spring pins.

13. The FZU mounting module of claim 9 wherein the chassis and cam arm are connected at their forward ends.

14. The FZU mounting module of claim 9 wherein the FZU adaptor has flat exterior faces.

15. The FZU mounting module of claim 9 wherein the FZU adaptor is rotatable at least 90 degrees, and wherein the FZU adaptor is substantially horizontal in a stowed position and substantially vertical in an open position.

16. The FZU mounting module of claim 9 wherein the FZU mounting module is mounted on the exterior of a penetrator.

17. A FZU mounting module comprising:

a. a chassis having a forward end, an aft end, and openings configured to receive a safety hinge pin;

b. a FZU adaptor attached to the chassis by a safety hinge pin, and rotatable about an axis of the safety hinge pin, the FZU adaptor having a threaded cavity having an internal circular cross section, and wherein the FZU adaptor is substantially horizontal in a stowed position and substantially vertical in an open position, and wherein the chassis is attachable outside of a penetrator casing.

18. The FZU mounting module of claim 17 wherein the FZU adaptor further comprises at least one FZU adaptor pin on its exterior, and the FZU adaptor pin is seated in a first position in a channel in a stowed position and a second position in the channel in the open position.

19. The FZU mounting module of claim 17 wherein the FZU adaptor is rotatable at least 90 degrees, and wherein the FZU adaptor is substantially horizontal in a stowed position and substantially vertical in an open position.

20. The FZU mounting module of claim 17 wherein the FZU adaptor has flat exterior faces.

* * * * *